United States Patent [19]

Thery

[11] Patent Number: 4,899,698

[45] Date of Patent: Feb. 13, 1990

[54] COMBUSTION CHAMBER FOR TWO-STROKE RECIPROCATING ENGINE, AND AND ENGINE MAKING USE THEREOF

[76] Inventor: Georges Thery, 6 Place du Général Leclerc, Pierrefitte

[21] Appl. No.: 216,200

[22] Filed: Jul. 7, 1988

[30] Foreign Application Priority Data

Oct. 30, 1987 [FR] France ..... 87 15118

[51] Int. Cl.[4] ..... F02B 33/04

[52] U.S. Cl. ..... 123/65 A; 123/73 A; 123/193 H 657

[58] Field of Search ..... 123/193 H, 193 CH, 65 A, 123/65 R, 73 R, 294, 65 W, 65 WA, 73 A, 657, 664, 65 P

[56] References Cited

U.S. PATENT DOCUMENTS

| | | | |
|---|---|---|---|
| 3,494,335 | 2/1970 | Meier | 123/65 |
| 3,680,305 | 8/1972 | Miller | 123/65 |
| 4,068,629 | 1/1978 | Houper | 123/65 S |
| 4,248,185 | 2/1981 | Jaulmes | 123/65 A |
| 4,253,433 | 3/1981 | Blair | 123/73 R |
| 4,258,670 | 3/1981 | Thery | 123/73 B |
| 4,598,673 | 7/1986 | Poehlman | 123/65 A |
| 4,638,770 | 1/1987 | Fox | 123/65 W |
| 4,671,219 | 6/1987 | Ooyama et al. | 123/65 A |
| 4,719,880 | 1/1988 | Schlunke et al. | 123/193 H |

FOREIGN PATENT DOCUMENTS

| | | | |
|---|---|---|---|
| 849624 | 9/1952 | Fed. Rep. of Germany . | |
| 2650834 | 6/1977 | Fed. Rep. of Germany . | |
| 2166420 | 8/1973 | France . | |
| 0063529 | 5/1977 | Japan | 123/193 H |
| 59-170423 | 9/1984 | Japan . | |
| 236103 | 6/1945 | Switzerland | 123/661 |
| 859487 | 1/1961 | United Kingdom . | |
| 2175953 | 12/1986 | United Kingdom . | |

*Primary Examiner*—David A. Okonsky

*Attorney, Agent, or Firm*—Sixbey, Friedman, Leedom & Ferguson

[57] ABSTRACT

The present invention relates to a combustion chamber in which two flows of gas are admitted via ports at the bottom of the cylinder, one of the flows being a mixture containing fuel and the other being a flow of pure air. These flows are admitted so that they meet inside the chamber close to the wall opposite from an exhaust port (5) so that the mixture is confined and slowed down in a cavity (9) in the cylinder head while the flow of pure air is split by an edge (12) formed between said cavity and the bottom wall (11) of the cylinder head so that one portion of this air flow returns and scavenges the combustion chamber (1).

15 Claims, 4 Drawing Sheets

COMBUSTION CHAMBER FOR TWO-STROKE RECIPROCATING ENGINE, AND AND ENGINE MAKING USE THEREOF

Two-stroke engines are widely used, both as point ignition engines and as diesel engines.

BACKGROUND OF THE INVENTION

In its simplest form, feed takes place via ports. In theory, at any given speed, it ought to produce twice the power of a four-stroke engine, since the number of drive strokes is doubled.

The power obtained in reality is very much less than the theoretical power, because cold gases are lost via the exhaust, particularly at low speeds.

In controlled-ignition engines, which are fed with a preformed mixture, mixture is lost to the detriment of consumption and pollution.

The design of these engines has remained very largely empirical. Nevertheless, it is known that losses to the exhaust come from:

suction by the exhaust into the conically-shaped reduced pressure zone in the combustion chamber due to the gas flows therein; and direct flow of admission content into the exhaust, thereby setting up both said exhaust pressure reduction and the admission pressure.

Proposals have been made to remedy this direct suction of admitted mixture, at least in part, by using a solid deflector, for example a projecting portion of the piston, in order to constitute an obstacle to such direct flow. Proposals have also been made to provide pneumatic deflection of the admitted flow of mixture, by establishing an admission flow directed away from the exhaust.

An effective solution of the problem of exhaust losses lies in direct fuel injection. Unfortunately, this technically acceptable feed device is economically unusable because it is much more expensive than the engine itself. It is therefore necessary to continue to use engines with a mixture that is pre-formed prior to admission into the cylinder.

In an earlier patent, the Applicant has proposed a combustion chamber including multiple admission, i.e. for admitting both a mixture formed prior to admission via an inlet in the opposite side of the cylinder to the exhaust outlet and a flow of air containing no fuel which is admitted via two symmetrical ports directed towards the wall furthest from the exhaust port so as to counterbalance the tendency of the mixture to move diametrically across the combustion chamber. These dispositions are used in combination with a cavity in the cylinder head for accumulating the mixture and for obtaining uniform combustion at top dead center.

In a recent study, a Japanese institute has shown the important role of such a cavity in the cylinder head in reducing losses of mixture flow to the exhaust. The study relates to an engine having single admission of fuel mixture.

The present invention relates to measures stemming from the above-mentioned study and from the Applicant's earlier patent, so as to delay the flow of mixture in the combustion chamber relative to the flow of the air contained in said chamber, thereby tending to avoid loosing mixture via the exhaust. The cavity constitutes a retention space because it reflects the air flow thereby setting up a flow in the opposite direction to the flow of mixture inside the cavity, thereby momentarily stopping said mixture flow at the top of the chamber.

SUMMARY OF THE INVENTION

To this end, the present invention provides a combustion chamber for a reciprocating, two-stroke, controlled-ignition, internal-combustion engine, comprising at least one piston, a cylinder, a cylinder head delimiting said combustion chamber, and admission and exhaust ports at the bottom of the cylinder, via which the components of an inflammable mixture are admitted from two admission devices, air without fuel being admitted via two ports close to the exhaust port and disposed symmetrically thereabout, with the axes of said two ports converging inside the chamber and being directed towards the wall opposite the exhaust port, whereas the mixture containing all of the fuel in air is admitted via at least one port provided in a portion of the cylinder wall which is opposite to the exhaust port. According to an important characteristic of the invention, the cylinder head includes a cavity whose portion furthest from the fuel admission port is delimited by a substantially vertical wall, with the axes of the admission devices leading to the above-mentioned admission ports being inclined in such a manner that the admitted flows meet at an angle enabling the fuel-containing flow to be dynamically deflected towards the wall through which it is admitted, and for deflecting the pure air flow towards the bottom edge of the connection between the above-mentioned vertical wall of the cavity and the surface of the cylinder head, said flow of pure air splitting on said edge so as to confine the mixture by means of a counter flow of air in the cavity, and simultaneously scavenge the zone of the combustion chamber adjacent to the exhaust port with pure air, thereby avoiding fuel losses via the exhaust.

It will be understood that the encounter between the two flows forces the flow of mixture to lie against the wall of the cylinder and to flow along said wall due to the Coanda effect. The mixture flow is thus channeled to a certain extent and is kept as far as possible from the exhaust port. Further, the flow of air tends to return towards the center of the combustion chamber and splits at the edge of the cavity in the middle of the cylinder head wall. The portion of the flow which is thus forced to move as a counterflow inside the cavity encounters the mixture flow and brakes it. It may be observed, that in order to collect all of the mixture flowing against the wall of the chamber, the cavity has a mouth opening out to the chamber whose width measures parallel to the horizontal width of the mixture admission port is not less than said horizontal width.

These measures make it possible to isolate the mixture effectively from the exhaust port while it is uncovered by the piston.

In order to improve the confinement of the mixture flow opposite from the exhaust, the duct leading to the mixture admission port may be directed in such a manner as to be as nearly axial as possible. This disposition also serves to avoid too sudden an interpenetration of the mixture flow with the two converging air flows, which interpenetration could set up infiltrations of mixture into the air going to the exhaust.

The scope of the invention extends to providing admission via two ports instead of via one port, or to providing admission of the mixture via an orifice situated at the top of the chamber diagonally opposite to the exhaust port, said orifice being provided with a shutter, in particular an automatic shutter having a return spring.

The dispositions of the invention are more advantageous if the two flows admitted into the combustion chamber are boosted in pressure. Thus, as a function of the various types of pressure boost which may be adapted to an engine provided with the above-specified combustion chambers, various different engines can be obtained at different costs.

In a simple embodiment, the pure air feed and the mixture feed are connected via transfer ducts to a single pressure-boosting device which may be the cylinder and crank case assembly beneath the piston into which a mixture is to be admitted. In order to avoid the fresh air and the fuel-containing air from mixing in said pressure-boosting assembly, the crank case and the cylinder beneath the piston each form a distinct feed enclosure including a separate admission orifice, with said enclosures being separated by a partition. This partition may be air-tight or not, given that the piston connecting rod passes through it.

In a cheap embodiment, there is a single pressure-boosting chamber without any separation therein, and it has an admission opening for one of the fluids situated in the crank case and an admission opening for the other fluid situated at the bottom of the cylinder portion, with the cross-sections of the mixture transfer channel and of the admission of said mixture into the pressure-boosting chamber having relative sizes such that the quantity of mixture transferred via the transfer duct is not more than the quantity of mixture admitted into the chamber.

The ratio at the bottom dead center between the volume of the enclosure containing the mixture and the total compressed volume beneath the piston is equal to or greater than the ratio between the admitted quantity of mixture and the total quantity of the two gas flows. The ratio between the quantity of mixture transferred and the total quantity of the flows transferred is thus not less than said volume ratio. Thus, the transferred mixture need not be as rich as the initially admitted mixture by virtue of a small amount of air dilution in the mixture. In order to reduce the risk of the mixture penetrating into the air, the air transfer orifice is provided with a filter element. This is particularly useful when lubrication is provided separately.

The crank case may be used for feeding mixture and the enclosure delimited by the cylinder beneath the piston may be used for feeding air. However, it should be observed that the quantity of mixture transferred must not exceed 50% of the total quantity admitted to the combustion chamber. Since the quantity sucked into the crank case is likely to be much greater than that, a device limits the admitted quantity to less than said percentage. For example, a partial shutter may be implemented or the size of the admission device may be reduced. However, additional admission may take place during transfer, with the carburetion device being connected in conventional manner to the mixture transfer duct via an admission non-return valve. However, precautions must be taken to prevent said additional feed from directly constituting a loss to the exhaust, since it is the exhaust pressure reduction which gives rise to it. In order to avoid such a phenomenon, provision must be made to admit additional separating air. To do this, the duct for transferring air from the bottom of the cylinder to the combustion chamber also includes a branch and an air duct provided with an admission non-return valve. The additional feed brought in by the exhaust pressure reduction will also cause additional separating air to be brought in in such a manner that the flow which is closest to the exhaust and which tends to escape under the effect of the suction therein is the air flow.

The pressure-boosting device may also be used the other way round, i.e. to compress the mixture in the enclosure defined by the portion of the cylinder situated beneath the piston and to compress the air in the crank case.

These two variant embodiments of a pressure-boosting device are of negligible cost for engines having separate lubrication. The only additional cost is that constituted by a second admission to the pressure booster, and this is largely compensated by better charging.

By slowing down the flow of the mixture in the cavity while simultaneously admitting additional air directly as sucked in by the exhaust pressure reduction improves charging and enhances elimination of mixture losses. By virtue of the dispositions of the invention, the gas flows are such that on the opposite side to the exhaust port, there is a greater head loss for the flow of additional mixture seeking to penetrate into the chamber closer to the exhaust. As a result, the suction created by the exhaust pressure reduction is essentially constituted by air with no fuel. The additional mixture which is nevertheless admitted into the chamber remains therein and is a factor contributing to better chamber charging.

The combustion chamber according to the invention may also be used for engines in which the flows in each cylinder are fed by two different devices.

In this case, for engines fed with mixture, the mixture is formed at normal pressure upstream from the feed device. The supercharging devices are brought together in at least one multipurpose pressure-boosting assembly in order to perform several functions and to provide at least two feeds. The number of pressure-boosting assemblies will be no more than one and a half times the number of combustion chambers in order to avoid increasing specific weight.

Without going into a detailed description of this type of embodiment, a particularly simple application is nevertheless mentioned which consists in providing a staged piston whose wider portion operates with the crank case to provide pumping and whose narrower portion defines, together with the cylinder in which the wider portion slides between top dead center and bottom dead center, a chamber of variable volume which constitutes the second pressure-boosting system. Since the volume of this chamber varies in the opposite direction to that of the crank case pump, a buffer capacity must be provided between said chamber and the corresponding feed port so that the two types of flow arrive at boosted pressures at the instant at which the combustion chamber is to be fed.

Another embodiment of a separate pressure-boosting device is constituted by a variable volume chamber provided in an additional cylinder other than the cylinder in which the driving piston is moving, with the moving wall of said variable volume chamber being a membrane. This additional cylinder may be provided using the engine case which constitutes the crank case pump and the system for boosting the pressure of one of the flows, with the membrane of the separate pressure-boosting system for the other flow being operated by an appropriate crank system between said membrane and the crank shaft. Said crank system may, naturally, be replaced by cam control or any other satisfactory mechanical device.

Other devices may also be envisaged. The pressure-boosting device may be completely separate from the engine case.

In a multicylinder engine, the pump case of each of the engine cylinders may also be used as a pressure-boosting device for each flow, with transfer channels together with buffer capacities where necessary, and carburetion devices being provided on the feed ducts of said pump cases or on some of them. Some of the pump cases may be specialized in boosting the pressure of pure air while others are specialized in boosting the pressure of air-fuel mixture.

In the same manner, it is also possible to group together cylinders including more complex pressure-boosting systems, for example cylinders have staged pistons as mentioned above. These may be combined in two-cylinder groups in order to take advantage of having only one casing and only two bearings. In this case, the two pistons having opposing wide portions are connected together in a single casing to the crank shaft via crank pins which are offset by 180° and interconnected by a web. This single pump casing serves to feed both cylinders with one of the fluids when their ports are simultaneously uncovered. Each of the cylinders is fed with the other fluid by the corresponding wide portion constituting the pump piston via transfer ducts provided with non-return valves in order to take account of the way these pump pistons operate in phase opposition.

Thus, and highly advantageously, this single double action pumping group operating on one side as a pump casing and on the other as a double feed piston pump provides a dual two-fluid feed function, for a quadruple utilization, both of these two fluids being distributed to two cylinders.

Finally, when mixture flow feed is provided separately by a membrane, the top dead center of the pressure-booster membrane may be retarded relative to the bottom dead center of the engine piston by between 120° and 60° by means of a corresponding offset of the pressure-booster membrane relative to the engine piston. It is also possible to adjust the strokes of each pressure-booster membrane in such a manner that the pressure of the mixture flow, for example, is less than the pressure of the air closest to the exhaust.

For engines in which each cylinder is fed with fluid by two different devices, it is advantageous to provide the mixture transfer duct, close to where it opens out into the chamber, with a device for controlling the admission of mixture into said chamber. The opening of the control device is retarded at least to bottom dead center of the engine piston in order to provide a retarded transfer of the mixture. This device could be constituted by a cylindrical plug rotated synchronously with engine rotation and having an internal passage for providing a free passage between bottom dead center and the closure of the mixture admission port.

BRIEF DESCRIPTION OF THE DRAWINGS

Embodiments of the invention are described by way of example with reference to the accompanying drawings, in which.

MORE DETAILED DESCRIPTION

Figure 1:
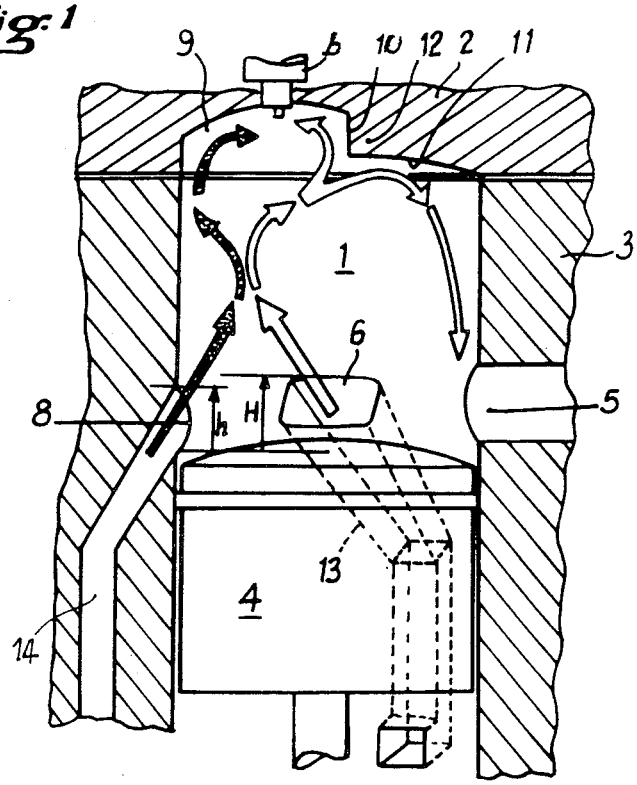
FIG. 1 is a diagrammatic axial section view through a combustion chamber in accordance with the invention.
Figure 2:
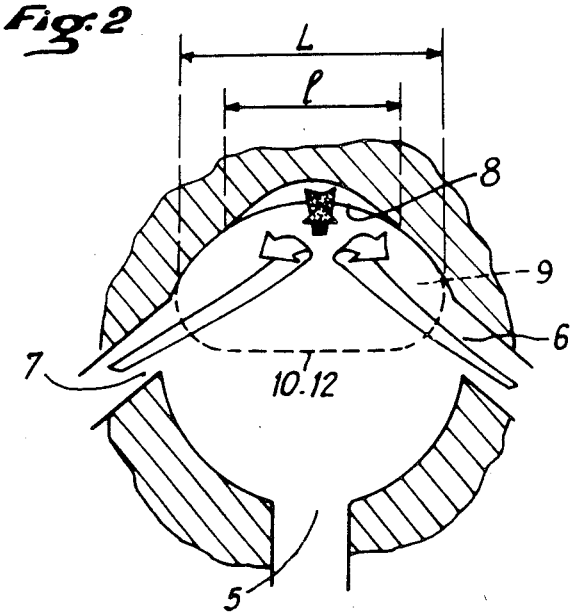
FIG. 2 is a diagrammatic diammetrical cross-section through said combustion chamber.

Reference is made initially to FIGS. 1 and 2 which show a combustion chamber 1 delimited by a cylinder head 2, a cylinder 3, and a piston 4 which is shown in this case at bottom dead center. In conventional manner, the chamber 1 includes an exhaust port 5 and a dual admission system. The system includes a first device constituted by two ports 6 and 7 which are disposed symmetrically about the vertical plane containing the exhaust port, and a second device constituted by a port 8 opening out into the chamber opposite to the exhaust port 5, and whose top edge is at a height h which is less than the height H of the top edges of the ports 6 and 7.

The cylinder head includes a cavity 9 adjacent to the wall of the cylinder opposite from the wall containing the exhaust port, with the width L (see FIG. 2) of the cavity being greater than the width l of the admission port 8, see cavity 9 having a substantially vertical wall 10 opposite to the wall of the cylinder provided with the admission port, and forming an edge 12 together with the remaining surface 11 of the cylinder head. An ignition member B is disposed in the top of the cavity 9.

The ports 6 and 7 are connected to respective admission tubes coming from a precompression system which, in the example shown, may be a crank case pump where the bottom face of the piston serves to expel the air present in the crank case via a transfer duct 13.

The duct 14 opening out into the combustion chamber via the port 8 is connected to a fuel-providing device either directly or indirectly. The following figures show several different locations where the fuel-providing device can be located on the duct 14.

In FIGS. 1 and 2, the black arrows symbolize the feed of fuel-containing mixture, whereas the white arrows symbolize the feed of pure air. If the ducts 13 and 14 are suitably oriented and open out into the combustion chamber 1 in such a manner as to converge on a single point, the flow tend to meet each other and push each other apart. As a result, the mixture flow is pressed against the wall of the chamber furthest from the exhaust port, and it continues to flow along said wall without coming unstuck therefrom by virtue of the Coanda effect. In contrast, the air containing no fuel is deflected upwardly and towards the interior of the combustion chamber. When this flow encounters the above-mentioned edge 12 and divides into two branches at said edge, one of the branches swirls into the cavity 9 against the mixture flow while the other swirls into the combustion chamber adjacent to the exhaust port 5 by reflection against the wall 11 of the cylinder head 2. This disposition serves to confine the admitted mixture into the portion of the chamber which is furthest from the exhaust port by setting up a zone in the cavity where the air flows oppose each other. As a result, at the end of exhaust flow, the fluid which is sucked into the exhaust is the flow of air containing no fuel and which has scavenged the combustion chamber.

This confinement effect is greatly improved by the design and orientation of the devices for admitting air-fuel mixture and pure air into the combustion chamber. Thus, arrangements are made to ensure that the duct 14 conveying the mixture into the combustion chamber is as nearly vertical as possible at its terminal portion so that the flow departs as little as possible from the wall of the cylinder.

Figure 3:
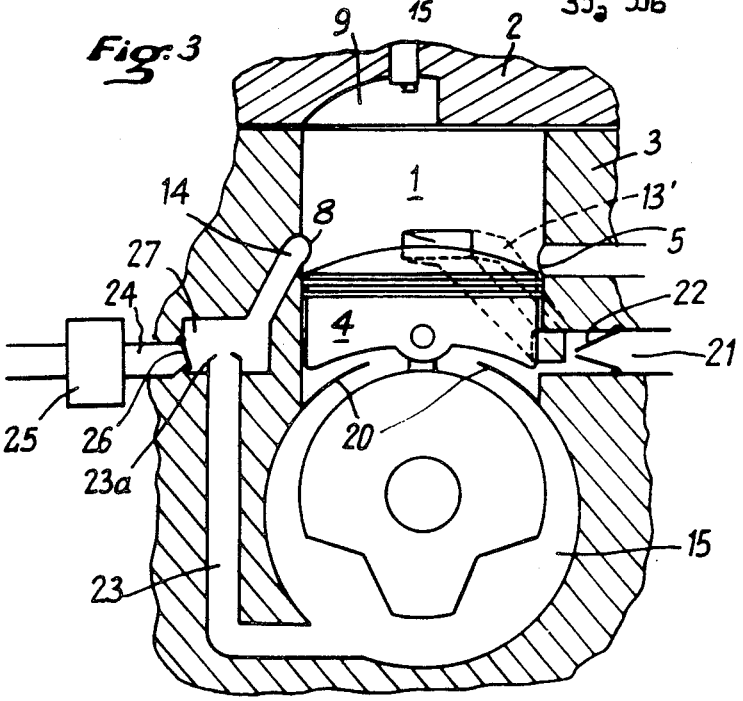
FIG. 3 is a diagram of a first embodiment of an engine using a combustion chamber in accordance with the invention.

FIG. 3 is a diagram showing a first application of the combustion chamber of the invention, in which the pressure-boosting device for the fuel feed and for the pure air feed is a pump crank case. Some of the items already described reappear in this figure with the same reference. The figure is highly diagrammatic and it is assumed that when the ports are covered by the piston they are closed in sealed manner.

Carburetion is provided at atmospheric pressure.

The pressure-boosting system comprises two superposed enclosures, a first enclosure which includes a variable volume chamber delimited by the bottom face of the piston 4, the bottom portion of the cylinder 3, and an incomplete partition 20 between said first enclosure and a second enclosure formed by the engine crank case 15. The first enclosure is fed via a duct 21 provided with a non-return valve 22 enabling air to be sucked into the variable volume chamber while preventing it from exhausting. The crank case 15 is connected via a duct 23 firstly to the duct 14 opening out into the port 8, and secondly to a duct 24 on which a carburetor 25 is installed. A non-return valve 26 prevents the gas compressed in the crank case 15 from returning into the duct 24. It may be observed that the duct 23 terminates in the form of a nozzle 23*a* in a portion 27 of the duct 14 which extends angularly around said nozzle 23*a* so that the fuel-containing mixture sucked into the duct 23 is decanted to some extent into the annular space formed by the duct 14 around the nozzle 23. The section of the nozzle 23 is determined as a function of the quantity of fuel-containing mixture which is to have its pressure boosted and as a function of the quantity of air whose pressure is boosted in the first stage.

Pure air admission port 6 into the combustion chamber is connected by the duct 13 to the above-mentioned variable volume chamber, and preferably in the vicinity of the feed duct 21 to said chamber, downstream from the non-return valve 22.

As the piston 4 rises towards top dead center, pressure is reduced both in the chamber situated beneath the piston and in the crank case 15. As a result, fresh air is sucked in via the duct 21 simultaneously with fuel-containing mixture being sucked in via the duct 23. Given the distances between these two suctions and the incomplete partition 20, the two sucked-in mixtures are well stratified in the pressure-boosting system and they mix very little. During the down-stroke of the piston, both mixtures are initially compressed and then simultaneously expelled towards the combustion chamber 1. In addition, if the exhaust pressure drop is sufficient, fuel-containing mixture may be directly sucked in from the duct 24, said mixture picking up extra fuel collected at the bottom of the chamber 27, and air containing no fuel is simultaneously sucked in via the duct 13, thereby opening the non-return valve 22. It can be seen that the air which escapes into the exhaust is pure air, since the pure air will take the place of the additional mixture admitted under the effect of the reduced pressure and attempting to pass directly into the exhaust. This disposition serves advantageously to improve combustion chamber charging.

Figure 4:
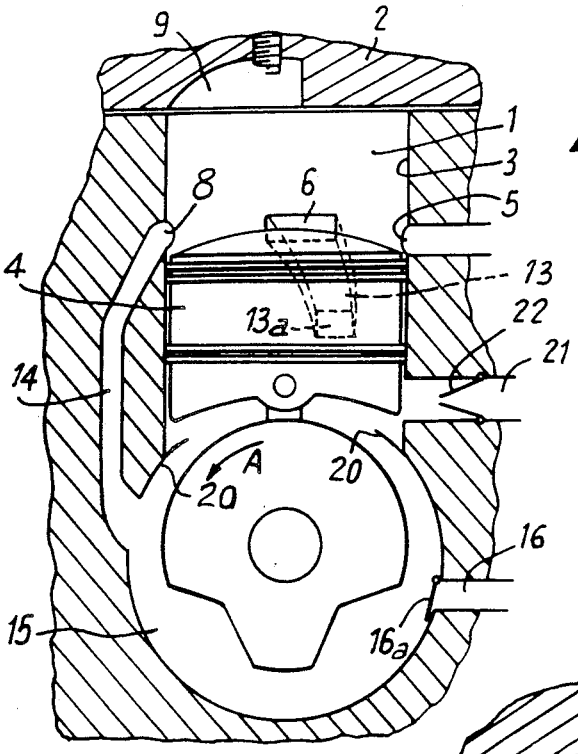
FIG. 4 shows a first variant of the FIG. 3 embodiment.

FIG. 4 shows a variant of the FIG. 3 embodiment in which the fuel-containing mixture is delivered to the bottom of the crank case 15 via a duct 16 and a non-return valve 16*a*.

Figure 5:
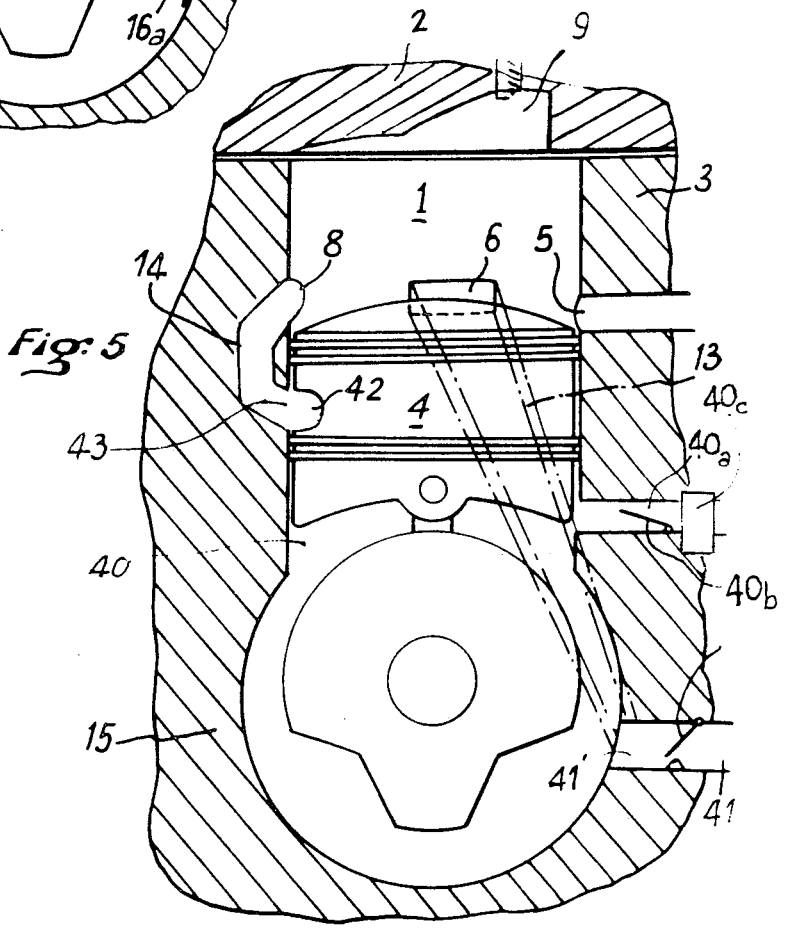
FIG. 5 shows a second variant of the FIG. 3 embodiment.

In another variant shown in FIG. 5, in which some of the items already described reappear with the same references, the mixture is admitted into the variable volume chamber 40 situated beneath the piston 4 via a duct 40*a* provided with a non-return valve 40*b* and a carburetor 40*c*, whereas air is admitted to the crank case 15 via a duct 41 provided with a non-return valve 41*a*. The air transfer duct 13 leaves the crank case 15 or a portion 41' of the duct 41 situated downstream from the non-return valve 41*a*, and is advantageously provided with a filter (not shown) for retaining lubrication liquids, particularly for engines which are separately lubricated. Finally, the skirt of the piston 4 includes an orifice 42 intended to coincide with the cylinder port 43 from which the duct 14 extends.

In FIG. 5, it is advantageous to provide for the sizes of the cross-section of the mixture transfer duct and of the duct for admitting said mixture into the pressure booster to be such that the quantity of mixture which is transferred is at least equal to that admitted. This prevents any danger of mixture diffusing into the air, the stratification of the two flows is maintained until transfer takes place, and it is possible to provide separate air and mixture feeds. Further, given that each stage of the pressure booster has a different type of turbulence (rotary in the crank case and reciprocating in the upper portion of the chamber), pneumatic separation occurs which prevents the mixture from penetrating into the air.

Figure 6:
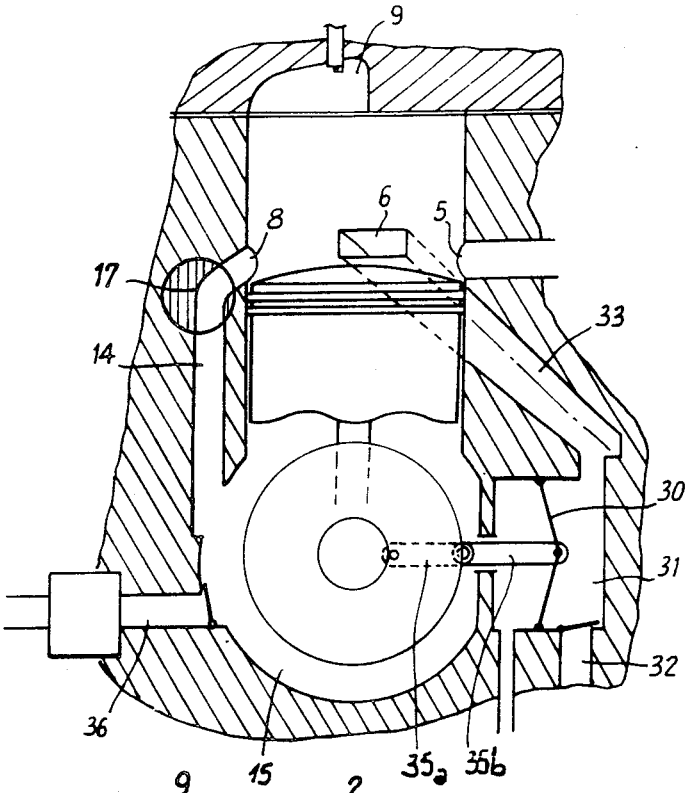
FIG. 6 shows a second embodiment of the engine.

FIG. 6 is a diagrammatic illustration of another embodiment of the invention in which the pressure-boosting device comprises the conventional crank case pump system and a moving-wall chamber system which is separate from the crank case pump. In this case, the moving-wall system is used to compress the fuel-less air going to port 6, but naturally it would be possible to interchange the functions of the crank case pump and of the moving-wall pressure booster system. This system is shown as being a deformable membrane 30 for varying the volume of a chamber 31 having a suction duct 32 and an outlet duct 33 leading to the port 6, with the deformable membrane 30 being connected to the crank shaft 34 via a crank 35*a* and a crank shaft 35*b*.

The carburetion device disposed on the feed duct 36 to the crank case pump 15 is shown diagrammatically in this case, but it may have the same shape as the device 25 shown in FIG. 3.

In a variant of this disposition (not shown), a moving wall may be provided for the chamber 31 constituted by a membrane for boosting the pressure of the air coupled via a connecting rod system to the crank shaft that may be disposed in the extension of the axis of the cylinder 3. Provision may also be made for the piston 4 and the membrane of the variable volume chamber 31 to be adjusted in such a manner that the chamber 31 reaches its smallest volume at the same time as the piston 4 reaches top dead center. In this case, the chamber 31 should be associated with a buffer capacity enabling the pressurized fluid to be retained until the piston 4 reaches bottom dead center, with the transfer duct 13 being provided with a non-return valve.

In FIG. 6, it will be observed that a controlled shutter 17 is provided in the form of a rotary plug which serves to keep the duct 14 open only during the time between piston bottom dead center and the closure of the admission port 8.

This disposition serves to retard the admission of the mixture, thereby providing additional advantages from the standpoint of charging. It also avoids direct injection by offering improved results at a construction cost which is of the same order as that for an ordinary separately-lubricated engine. The above description with respect to FIG. 6 is equally applicable to the other embodiments of the invention. The rotary plug may be replaced by some other form of controlled valve.

Figure 7:
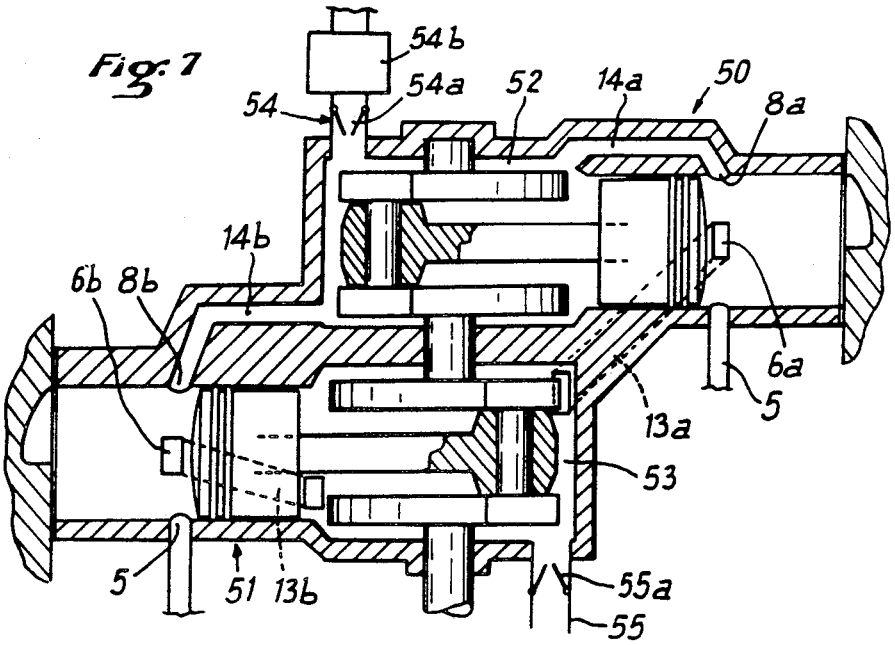
FIG. 7 is a diagram of a two-cylinder engine in which pressure boost is provided by two pump cases.

Numerous other dispositions are capable of boosting the feed pressure of an engine fitted with combustion chambers in accordance with the invention in simple manner. Thus, FIG. 7 shows an embodiment having two cylinders 50 and 51, e.g. a flat-twin, with one of the crank case pumps 52 serving to boost the pressure of the flow of fuel-containing mixture admitted by a duct 54 fitted with a non-return valve 54*a* and a carburetor 54*b*, and with the other crank case pump 53 being used to boost the pressure of pure air which is admitted by a duct 55 provided with a non-return valve 55*a*. The transfer ducts 13*a* and 13*b* connect crank case 53 to the two ports 6*a* and 6*b*, and transfer ducts 14*a* and 14*b* connect the crank case pump 52 for boosting the pressure of the mixture to ports 8*a* and 8*b*.

Figure 8:
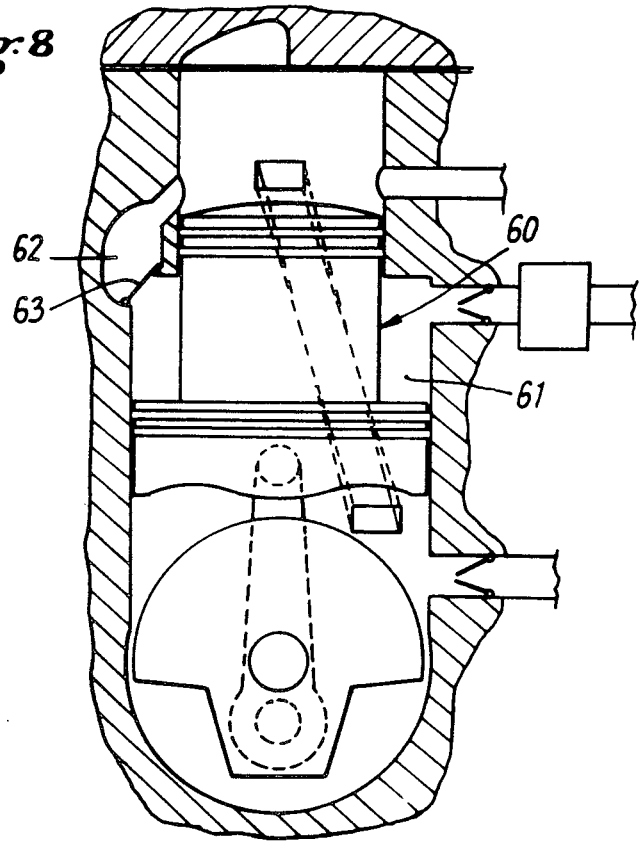
FIG. 8 is a view of an engine providing pressure boost by a staged piston.

Mention is also made (see FIG. 8) of the possibility of providing pressure-boosting systems by means of a staged piston 60 which, together with the cylinder between the combustion chamber and the crankcase pump, defines an annular space 61 of variable volume which may be used as a chamber for compressing one or other of the fluids admitted into the combustion chamber (in this figure for compressing the fuel-containing flow). However, the chamber 61 should be associated with a buffer capacity 62 provided with a non-return valve 63 since it has its minimum volume when the piston 60 is at top dead center and thus at the end of the suction phase of the crank case pump situated beneath it.

One set of staged cylinders may be associated with another in an arrangement of the flat-twin type sharing a common crankcase pump.

Naturally, the invention may also be applied to systems using separate pressure boosters for distributing the two flows into each of the combustion chambers of the engine, such systems may be constituted by conventional reciprocating or rotary devices (lobe pumps, vane pumps, . . . ).

The invention is applicable to internal combustion engines.

I claim:

1. A combustion chamber for a reciprocating, two-stroke, controlled-ignition, internal-combustion engine, comprising at least one piston, a cylinder, a cylinder head delimiting said combustion chamber, and admission and exhaust ports at the bottom of the cylinder, via which the components of an inflammable mixture are admitted from two admission devices, air without fuel being admitted via two ports close to the exhaust port and disposed symmetrically thereabout, with the axes of said two ports converging inside the chamber and being directed towards the wall opposite the exhaust port, whereas the mixture containing all of the fuel in air is admitted via at least one port provided in a portion of the cylinder wall which is opposite to the exhaust port, wherein the cylinder head includes a cavity whose portion furthest from the fuel admission port is delimited by a substantially vertical wall, with the axes of the admission devices leading to the abovementioned admission ports being included in such a manner that the admitted flows meet at an angle enabling the fuel-containing flow to be dynamically deflected towards the wall through which it is admitted, and for deflecting the pure air flow towards the bottom edge of the connection between the above-mentioned vertical wall of the cavity and the surface of the cylinder head, said flow of pure air splitting on said edge so as to confine the mixture by means of a counter flow of air in the cavity, and simultaneously scavenge the zone of the combustion chamber adjacent to the exhaust port with pure air, thereby avoiding fuel losses via the exhaust.

2. A combustion chamber according to claim 1, wherein the width L of the opening of the cavity in the vicinity of the vertical wall measured parallel to the horizontal width l of the mixture admission port is the largest dimension of the cavity and is greater than the above-specified width l.

3. An engine including at least one combustion chamber according to claim 1, wherein said engine includes a single pressure-boosting device having two outlets and connected via respective transfer ducts to the air admission ports and to the mixture admission port, said pressure-boosting device being constituted by at least one variable volume chamber delimited between the piston and the crank case.

4. An engine according to claim 3, wherein the above-specified variable volume chamber has a partition dividing it into two enclosures.

5. An engine according to claim 3, wherein one of said two outlets is disposed at the base of the cylinder portion, and the other of said two said outlets is disposed in said crank case, with an admission duct for one of the fluids opening out into the bottom of said cylinder portion, and an admission duct for the other fluid being connected to the crank case, with the cross-sections of the mixture transfer duct and of the ducts for admitting mixture into the above-mentioned variable volume chamber being of relative sizes such that the quantity of mixture transferred by said transfer duct is at least equal to the quantity of mixture admitted into the chamber.

6. An engine according to claim 5, wherein the portion of the variable volume chamber housed in the crank case is used for boosting the pressure of the mixture, and the cylindrical portion of said chamber housed beneath the piston is used for boosting the pressure of pure air.

7. An engine according to claim 5, wherein the cylindrical portion of the variable volume chamber beneath the piston is used for boosting the pressure of the admitted mixture, whereas the portion of said chamber housed in the crank case is used for boosting the pressure of pure air.

8. An engine according to claim 6, wherein the admission duct of the portion of the variable volume chamber housed in the crank case is constituted by a portion of the transfer duct between said zone and the mixture admission port, said portion having a branch connected thereto which is provided with a carburetor and a non-return valve.

9. An engine according to claim 8, wherein the branch is connected concentrically by a chamber to the portion of the admission duct which leads to the pressure-boosting pump and which forms a nozzle in said concentric chamber.

10. An engine according to claim 3, wherein the pressure-boosting device comprises two variable volume chambers, said chambers being separated by a membrane coupled to a drive member connected to the crank shaft.

11. An engine according to claim 3, wherein the pressure-boosting device is constituted by a staged engine piston defining an annular pressure-boosting chamber for boosting the pressure of one or other of the flows and connected to the combustion chamber via a buffer capacity having a non-return valve, the other flow being compressed between the crank case and the piston.

12. An engine according to claim 3, including at least two cylinders operating in-phase, wherein the crank-case pump of one of them constitutes the mixture pressure boosting device for both combustion chambers while the crank-case pump of the other of them constitutes the pure air pressure boosting device for both chambers.

13. An engine according to claim 3, including a member for closing the mixture transfer duct and controlled to open from the time the piston is at bottom dead center until the corresponding admission port is closed.

14. An engine according to claim 3, wherein the feed duct of pure air to said variable volume chamber is provided with a non-return valve, said air transfer duct being connected in the vicinity of said feed duct, downstream of said return valve.

15. An engine according to claim 3, wherein said transfer duct to the mixture admission port is provided with a controlled shutter.

* * * * *